United States Patent [19]

Gallaro et al.

[11] 4,405,880

[45] Sep. 20, 1983

[54] DATA DISPLAY CRT HAVING A YELLOW-EMITTING SCREEN

[75] Inventors: Anthony V. Gallaro, Auburn; Robert A. Hedler, Seneca Falls, both of N.Y.

[73] Assignee: North American Philips Consumer Electronics Corp., New York, N.Y.

[21] Appl. No.: 272,610

[22] Filed: Jun. 11, 1981

[51] Int. Cl.[3] ..... H01J 31/00

[52] U.S. Cl. ..... 313/467; 252/301.6 F

[58] Field of Search ..... 313/467; 252/301.6 F

[56] References Cited

U.S. PATENT DOCUMENTS

B 381,709 1/1976 Lipp ..... 252/301.6 F 2,400,925 5/1946 Graff ..... 252/301.6 F

FOREIGN PATENT DOCUMENTS 51-101795 8/1976 Japan ..... 313/467

*Primary Examiner*—David K. Moore

*Assistant Examiner*—Sandra L. O'Shea

*Attorney, Agent, or Firm*—Thomas A. Briody; Jack Oisher; John C. Fox

[57] ABSTRACT

The invention provides an advantageous blend of green and orange-emitting phosphors to constitute an improved substantially yellow-emitting screen component in a data display CRT. The blended component evidences medium-long persistence and thereby provides substantially flicker-free imagery when the tube is expeditiously employed in conjunction with field refresh rates of 20 to 40 Hz.

5 Claims, 2 Drawing Figures

DATA DISPLAY CRT HAVING A YELLOW-EMITTING SCREEN

REFERENCE TO RELATED APPLICATIONS

This application contains matter related to but not claimed in United States patent application filed concurrently herewith and assigned to the assignee of the present invention. This related application is Ser. No. 272,608 now U.S. Patent No. 4,377,768, issued March 22, 1983.

TECHNICAL FIELD

This invention relates to a monochrome data display cathode ray tube (CRT) and more particularly to a tube employing a screen formed of a blend of phosphors producing a substantially yellow color emission and exhibiting sufficient decay persistence to provide a substantially flicker-free image display at low refresh rates of operation.

BACKGROUND ART

Color-emitting phosphor components for a CRT data display screen are selected according to certain characteristics, such as: hue, brightness and rate of decay or persistence. Due to the nature of data display applications, which may often portray substantially static imagery with periodic updating, it is desirable to have luminescent emission whereof substantially continuous and concentrated viewing will produce a minimum of eye fatigue.

In display tubes operated in accordance with present television standards of 525 horizontal scan lines per frame, each frame of information is scanned twice by the exciting electron beam. This rapidly moving beam travels from left to right and from top to bottom across the screen of the tube at a uniform sweep pitched at a slightly downward slope. At the end of each horizontal line, the beam is returned at a greater velocity to the left side of the screen by an action known as horizontal retrace. Simultaneously to the horizontal sweep and retrace, each scan of the beam is pulled downward by the vertical sweep. When the horizontal sweep reaches the bottom of the screen, the vertical retrace returns the beam back to the top of the screen for the beginning of the next scan. In this manner, each vertical sweep of the screen is accompanied by 262.5 horizontal sweeps and, as such, forms a "field" which contains only half of the display imagery of a complete frame. The first vertical sweep of each frame, known as the "odd field", fills the odd-numbered lines of the 525 in order from top to bottom, while the related second vertical sweep or "even field" fills in the even-numbered lines of the frame. The combining of these "odd" and "even fields", each comprising 262.5 lines, is known as "interlaced scanning".

By conventional television standards, each vertical sweep or field is accomplished in 1/60 of a second or 16.66+ milliseconds. This frequency of field scanning is designated as a repeat or refresh rate of 60 Hertz (Hz). Since two fields constitute a complete 525-line of display imagery, the frequency rate of frame production is thirty per second, or once every 33.33+ milliseconds.

Cathodoluminescent phosphors employed in CRT screens exhibit two related luminescent characteristics: fluorescence and phosphorescence. Fluorescence is the luminescent build-up or emission of light released from the phosphor during the time of electron beam excitation. Phosphorescence is the emission of light from the phosphor occurring after the cessation of electron beam excitation. The duration of phosphorescence, or rate of decay of afterglow, is denoted as persistence. This is usually expressed as a measurement of time required for the phosphorescence to reduce or decay to a ten percent level of steady state fluorescent brightness.

Phosphors selected for utilization in data display CRT's, operated in accordance with the aforedescribed interlaced scanning at a 60 Hz rate of field refresh, exhibit decay persistances substantially within the range of 500 microseconds (μ sec) to one millisecond (M sec), and as such, are generally classified as having medium to medium-short persistences. These phosphors, when excited under the aforenoted operating conditions in conjunction with the visual persistence acuity of the human eye, provide a display which is interpreted by the observer as substantially flicker-free imagery.

It has been found that a marked reduction in display terminal equipment costs can be realized by utilizing less expensive components and circuitry to provide a scan refresh rate less than the conventional 60 Hz. But, when an economical rate of field refresh, for example, in the order of 20 to 40 Hz, is employed in exciting CRT screens comprised of conventional medium persistence phosphors, noticeable flicker or brightness variation becomes evident in the screen display. This produces a deleterious viewing situation which is both distracting and fatiguing for the operator of the data display terminal.

DISCLOSURE OF THE INVENTION

It is therefore an object of the invention to reduce and obviate the aforementioned disadvantages evidenced in the prior art. Another object of the invention is the provision of a monochrome data display CRT employing a medium-long persistence substantially yellow-emitting screen component substantially defined by C.I.E. color coordinates within the range substantially delineated by "x" 0.505, "y" 0.475 and "x" 0.410, "y" 0.545. This substantially yellow-emitter is comprised of a blend of known phosphors evidencing persistence characteristics capable of producing a substantially flicker-free image display at scanning refresh rates substantially within the range of 20 to 40 Hz. For example, a 30 Hz field refresh rate is 33.33+ milliseconds.

The substantially yellow-emitting phosphor blend is comprised of a green-emitting phosphor evidencing a medium-long persistence and exhibiting a bright excited hue substantially defined by C.I.E. color coordinates having an "x" value in the order of 0.210±0.010 and a "y" value of substantially 0.700±0.010.

A second element of the blend is an orange-emitting phosphor evidencing a medium-long persistence and exhibiting a bright hue substantially defined by color coordinates having an "x" value in the order of 0.550±0.010 and a "y" value of substantially 0.440±0.010.

Discretely blending these phosphors produces the desired component of the invention evidencing strong color emission in the region of predominant spectral sensitivity of the human eye. As such, it is aesthetically appealing for data display presentation.

BEST MODE FOR CARRYING OUT THE INVENTION

For a better understanding of the present invention, together with other and further objects, advantages and capabilities thereof, reference is made to the following disclosure and appended claims taken in conjunction with the aforedescribed drawings.

Figure 1:
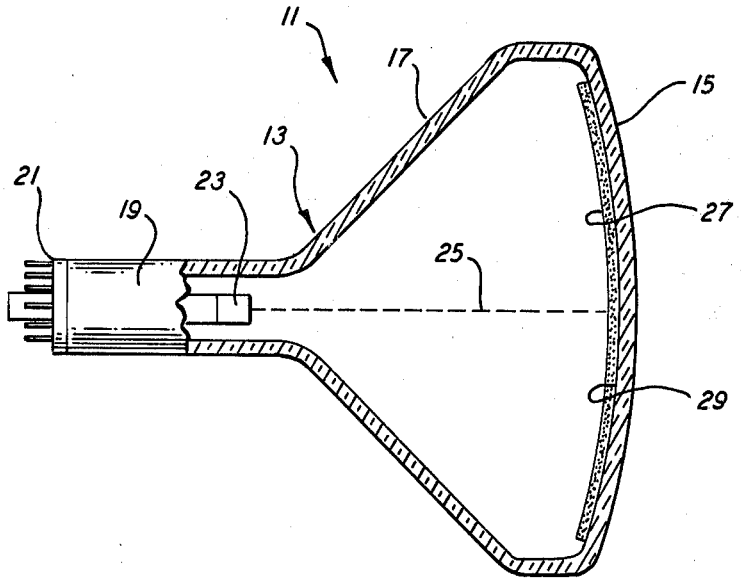
FIG. 1 is a partially sectioned monochrome data display CRT wherein the invention is utilized.

With reference to the drawings, there is shown in FIG. 1 a monochrome data display CRT 11 comprising an evacuated envelope 13 having a viewing panel portion 15, a funnel portion 17 and a restricting neck portion 19. Attached to the terminal end of the neck portion 19 is an insulative base member 21 which has a plurality of electrical conductive means extending therethrough for connecting the several tube electrodes with their associated receiver circuitry. Within the neck portion 19 there is mounted an electron generating means 23 from which emanates at least one predetermined electron beam 25 that is utilized in the operation of the tube. A cathodoluminescent screen 27, comprised of the substantially yellow-emitting blend of phosphors of the invention, is formed by conventional techniques on the interior surface 29 of the light-transmissive viewing panel 15.

Figure 2:
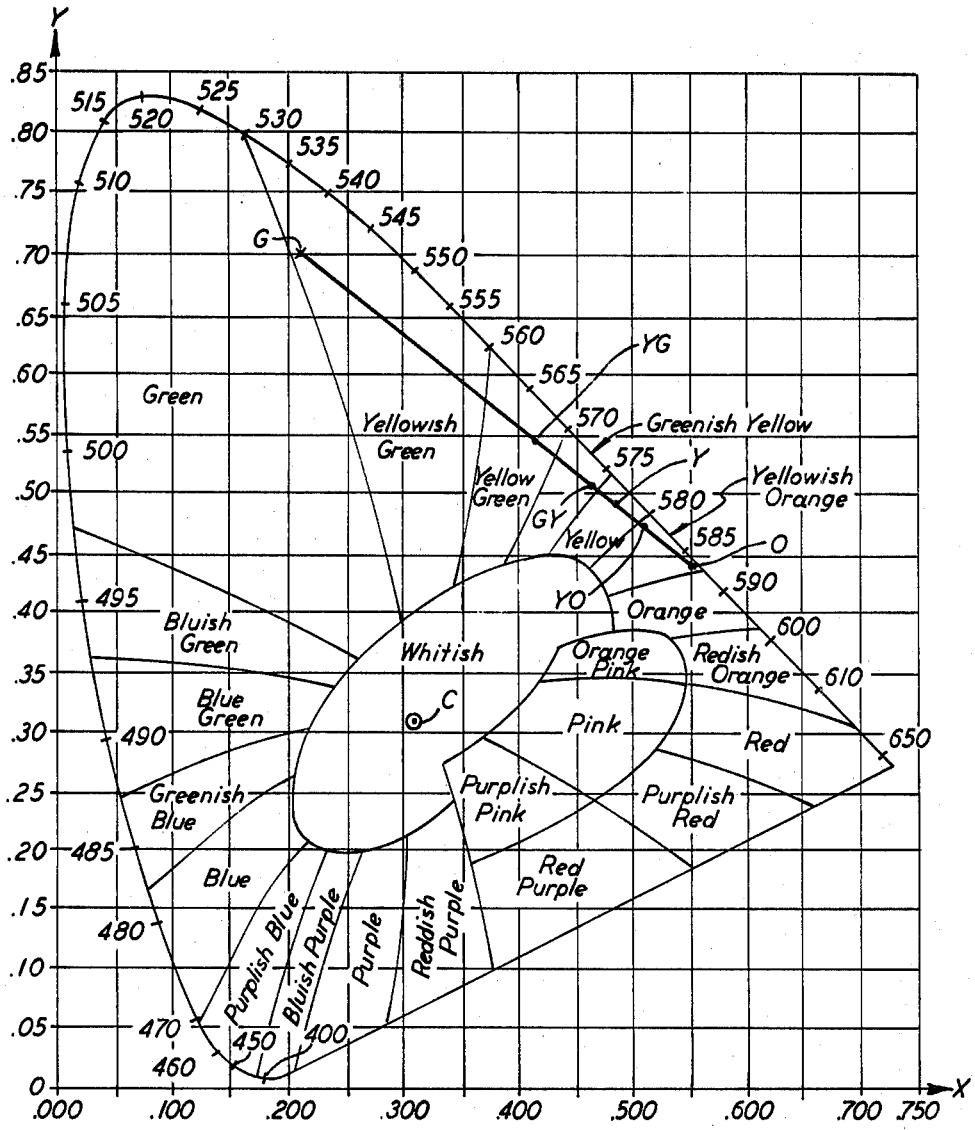
FIG. 2 illustrates a standard C.I.E. chromaticity diagram wherein the exemplary color coordinates of the invention are defined.

To facilitate description of the composition and color response of the substantially yellow-emitting component of the invention, reference is directed to FIG. 2 wherein there is shown a standard C.I.E. (Commission Internationale d'Eclairge) chromaticity diagram whereupon definitive "x" and "y" color coordinates may be plotted to designate specific hues. The periphery of the horseshoe-shaped figure defines a monochrome locus of which the blue and red ends of the spectrum are spanned by a line forming a locus of pure purple. Encompassed within the loci of the chromaticity diagram is a range of colors comprising the visible spectrum to which the normal human eye is sensitive. A sequential series of numbers, noted adjacent to the loci, indicate pure spectral wavelengths expressed in nanometers (nm). Thus, the hue of any color can be defined in terms of "x" and "y" coordinates.

The central area of the diagram is the "whitish" region, and as the hue designations approach this region, the colors become less saturated, i.e., they contain more white. Shown is Illuminant "C" which is very nearly average daylight, having a color temperature of about 6800° K. Such is substantially delineated by "x" and "y" coordinates of 0.310 and 0.316, respectively.

The invention relates to a data display CRT wherein the monochrome screen is formed of a distinctive substantially yellow-emitting component comprised of a homogenous blend of two discretely selected known phosphors, emitting green and orange hues, respectively. Each of these contributors evidences a desired hue, brightness, burn resistance and sufficient persistence to produce a substantially flicker-free monochrome image display at a field refresh rate of 20 to 40 Hz. Because of the prevalence of substantially static displays, with periodic revisions, phosphor burn resistance is an important consideration in data display screens. The respective phosphors utilized herein are found to be substantially equivalents in burn resistance and have proven to be satisfactory for the usage.

For this description, the invention is incorporated into a 12-inch solid screen CRT. The brightness is measured in foot lamberts, resulting from an operating anode voltage of substantially 15 KV and a beam current density of 50 microamperes. The brightness values measured in a monochrome CRT application, as described herein, are brighter than those evidenced in a multi-color tube having a foraminous mask or grid member oriented adjacent to a patterned screen.

In this instance, the persistence characteristics relate to the intervals of phosphorescent decay to ten percent of steady state brightness, such being measured of a pulsed spot excited to full luminance by substantially 15 KV and 0.3 microampere excitation. Persistence measured by the spot technique tends to produce readings of lower values than those obtained by the method employing evaluation of line-scan excitation.

The green-emitting portion of the blend is a zinc orthosilicate host co-activated with manganese and arsenic ($Zn_2SiO_4$:Mn:As). This selected known material exhibits a hue designated as "G" in the C.I.E. diagram of FIG. 2 and is defined as having an "x" value in the order of 0.210±0.010 and a "y" value in the order of 0.700±0.010. Individually, this phosphor in a monochrome environment is found to exhibit a brightness or intensity of substantially 50 foot lamberts. As such, it is the brighter of the two phosphors in the blend. Its persistence is evidenced as medium-long, being substantially in the order of at least 32 milliseconds.

The orange-emitting portion of the mixture is a cadmium silicate host co-activated with manganese and arsenic ($CdSiO_3$:Mn:As). Its hue is denoted at "O" in the C.I.E. diagram of FIG. 2 and is substantially defined as having an "x" value in the order of 0.550±0.010 and a "y" value in the order of 0.440±0.010. Individually, this phosphor is found to exhibit a brightness of substantially 30 foot lamberts in a monochrome setting. Its persistence is evidenced as medium-long, being in the order of at least 35 milliseconds.

The blending of the two aforedescribed phosphors to achieve a desirable substantially yellow-emitting component of medium-long persistence is accomplished by homogeneously mixing the contributors broadly in the proportions of 10 to 30 weight percent of green-emitting $Zn_2SiO_4$:Mn:As with 90 to 70 weight percent of orange-emitting $CdSiO_3$:Mn:As. The brightness ranges substantially from about 37 to 41 foot lamberts, whereof the brightness tends to increase as the percentage of green becomes greater in the blend. The persistence may vary somewhat, but is substantially in the order of at least 34 milliseconds.

More specifically, varying the ratios of the blend, in accordance with the scope of the aforenoted range, yields exemplary hues as follows:

| Green Emitter ($Zn_2SiO_4$:Mn:As) Weight % ± 2 | Orange Emitter ($CdSiO_3$:Mn:As) Weight % ± 2 | Hue (See FIG. 2) | Approx. Coordinates ± 0.010 "x" | "y" |
|---|---|---|---|---|
| 30 | 70 | YG | 0.410 | 0.545 |
| 20 | 80 | GY | 0.460 | 0.505 |
| 15 | 85 | Y | 0.480 | 0.490 |
| 10 | 90 | YO | 0.505 | 0.475 |

An example of the purest yellow emission is that designated in the above data as "Y", such being a blend of substantially 15±2 weight percent of green-emitting $Zn_2SO_4$:Mn:As and substantially 85±2 weight percent of orange-emitting $CdSiO_3$:Mn:As. The brightness registered by this particular mixture is found to be in the order of 38 foot lamberts.

The substantially yellow tonal emissions afforded by blends of the invention are aesthetically eye-pleasing to the observer and fully satisfy the requirements of field refresh rates in the range of 20 to 40 Hz. This discrete medium-long persistence blend offers markedly improved overall performance in terms of freedom from flicker, brightness, color rendition and burn resistance, when compared with previously used blends.

While this substantially yellow-emitting component is herein described as the luminescent emitter in a monochrome data display CRT, it is evident that this particular blend of phosphors can also be utilized as a medium-long persistence yellow-emitting portion of a plural component multi-color CRT screen, if such is desired. Such breadth is considered to be within the scope of the invention and coverage for the same is therefore included in the appended claims.

While there has been shown and described what are presently considered to be the preferred embodiments of the invention, it will be obvious to those skilled in the art that various changes and modifications may be made therein without departing from the intended scope of the invention as defined by the appended claims.

INDUSTRIAL APPLICABILITY

The data display CRT utilizing the described substantially yellow-emitting blend is a marked advancement in the art. The selection of the contributing phosphors relative to hue, brightness, burn resistance and persistence enables the fabrication of a screen that is efficiently responsive to field refresh rates of 20 to 40 Hz. The usage of such tubes enables the economical construction of display terminals incorporating less expensive components and simplified circuitry. In addition, the color rendition is both pleasing to the eye and viewable with a minimum of fatigue.

What is claimed is:

1. A monochrome data display cathode ray tube having means for forming and directing an electron beam to impinge a cathodoluminescent screen disposed on the viewing area and constituted of a bright substantially yellow-emitting screen component evidencing medium-long image persistence and capable of exhibiting a selected hue substantially defined by C.I.E. color coordinates within the range substantially delineated by "x" 0.505, "y" 0.475 and "x" 0.410, "y" 0.545, said screen component being formed of a discrete blend of phosphors comprising:

a medium-long persistence green-emitting phosphor evidencing an excited hue substantially defined by C.I.E. color coordinates having an "x" value in the order of 0.210±0.010 and a "y" value of substantially 0.700±0.010; said green emitting phosphor is a zinc ortho-silicate host co-activated with manganese and arsenic ($Zn_2SiO_4$:Mn:As); and a medium-long persistence orange-emitting phosphor evidencing an excited hue substantially defined by an "x" value in the order of 0.550±0.010 and a "y" value of substantially 0.440 ±0.010, said orange-emitting phosphor is a cadmium silicate host co-activated with manganese and arsenic ($CdSiO_3$:Mn:As).

2. The monochrome data display cathode ray tube according to claim 1 wherein said substantially yellow-emitting component is formed of a blend of substantially 10 to 30 weight percent of $Zn_2SiO_4$:Mn:As, and of substantially 90 to 70 weight percent of $CdSiO_3$:Mn:As.

3. The monochrome data display cathode ray tube according to claim 1 wherein said substantially yellow-emitting component is formed of a blend of substantially 15 ± 2 weight percent of $Zn_2SiO$:Mn:As and of substantially 85 ± 2 weight percent of $CdSiO_3$:Mn:As.

4. A medium-long persistence substantially yellow-emitting cathodoluminescent phosphor component for use in a data display CRT screen, said component being formed of a blend of phosphors comprising:

substantially 10 to 30 weight percent of green-emitting $Zn_2SiO_4$:Mn:As; and substantially 90 to 70 weight percent of orange-emitting $CdSiO_3$:Mn:As.

5. The medium-long persistence substantially yellow-emitting cathodoluminescent CRT phosphor component according to claim 4 wherein the blend is substantially 15±2 weight percent of $Zn_2SiO_4$:Mn:As, and of substantially 85±2 weight percent of $CdSiO_3$:Mn:As.

* * * * *